United States Patent [19]

Gustavsson et al.

[11] Patent Number: 4,722,057

[45] Date of Patent: Jan. 26, 1988

[54] METHOD AND APPARATUS FOR REDUCTION OF THE MAGNETIC IDENTITY FOR SHIP PARTS WHICH ARE MOVABLE FOR THEIR BEARING AND ELEVATION

[76] Inventors: Lars-Göran Gustavsson, Vårbovägen 14, S-702 30 Örebro; Hans Kindroth, Box 911 B, S-688 00 Storfors; Roland Åhs, Pl 8057, S-693 00 Degerfors, all of Sweden

[21] Appl. No.: 772,521

[22] Filed: Sep. 4, 1985

[30] Foreign Application Priority Data

Sep. 4, 1984 [SE] Sweden ..... 8404402

[51] Int. Cl.[4] ..... G06F 15/20

[52] U.S. Cl. ..... 364/423; 89/1.13; 102/402; 324/245

[58] Field of Search ..... 369/423; 324/228, 244–245; 89/1.13; 102/402

[56] References Cited

U.S. PATENT DOCUMENTS 2,549,845 4/1951 Mouzon ..... 324/345

4,058,782 11/1977 Forster ..... 361/146

*Primary Examiner*—Jerry Smith

*Assistant Examiner*—Gail Hayes

*Attorney, Agent, or Firm*—Pollock, Vande Sande & Priddy

[57] ABSTRACT

The present invention relates to a method and an apparatus for the reduction of the magnetic identity for such ship parts, primarily ship's guns, the aiming, fire control and possibly firing of which are controlled by a computer. The computer is used to control amplifiers which supply electromagnetic coils built in around the part with the current required for compensation of the magnetic identity of the gun in every specific position. The calculations performed by the computer are based on information on the latitude, course, speed and rolling and pitching position of the ship which it continually fetches from the log of the ship and a gyro reference system as well as on information on the angles of traverse and elevation of the gun which it continuously fetches from angle transducers disposed on the gun.

4 Claims, 1 Drawing Figure

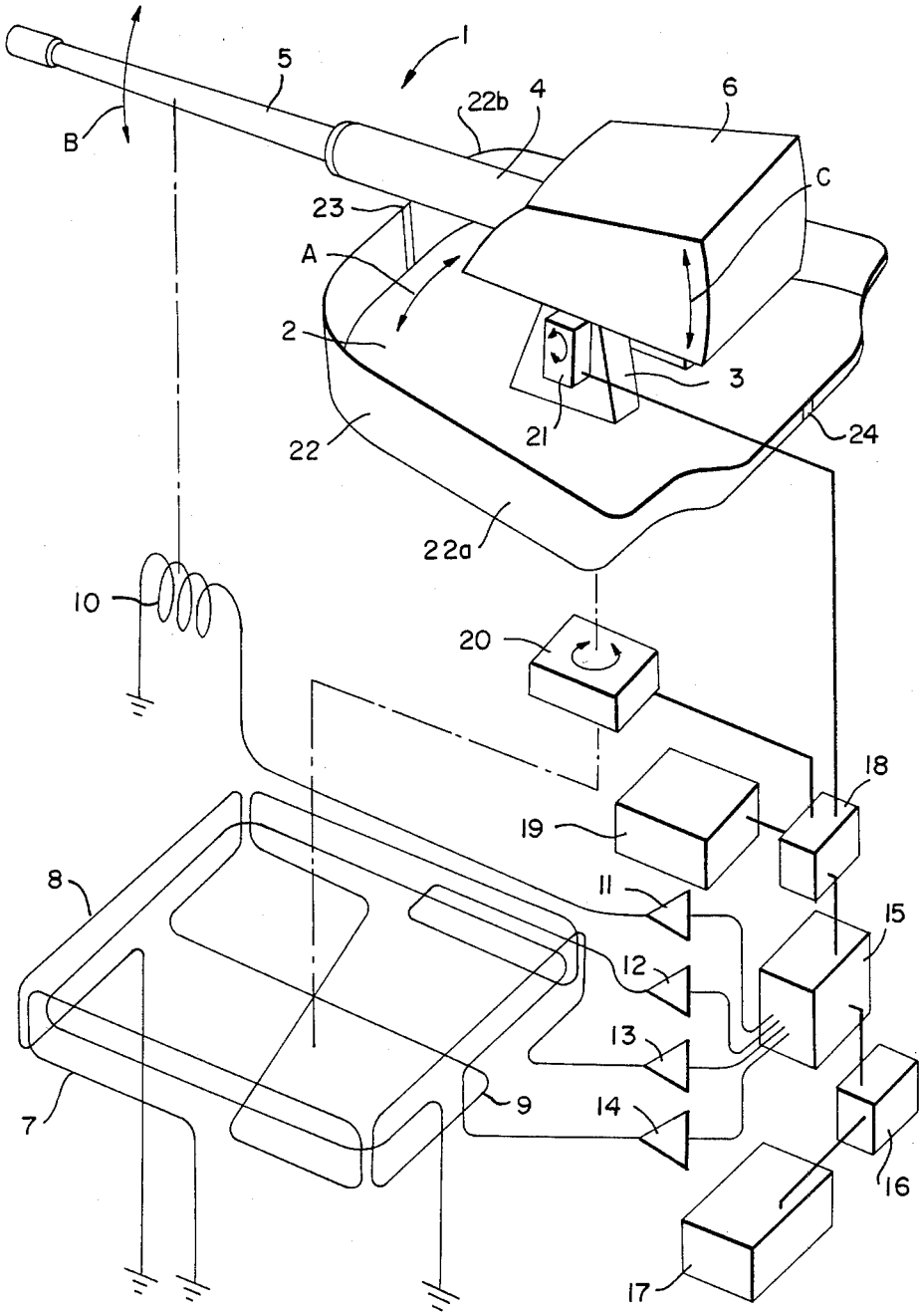
1
5
B
22b
4
6
C
23
A
2
3
21
24
22
22a
10
20
18
19
8
11
15
12
13
9
14
7
16
17

METHOD AND APPARATUS FOR REDUCTION OF THE MAGNETIC IDENTITY FOR SHIP PARTS WHICH ARE MOVABLE FOR THEIR BEARING AND ELEVATION

BACKGROUND OF THE INVENTION

The present invention relates to a method and an apparatus for the reduction of the magnetic identity for ship parts which are movable for their bearing and elevation, primarily artillery guns, the aiming and possibly also firing of which are controlled by a computer. The reduction of the magnetic identity of the part is accomplished by means of an active, computer-controlled electromagnetic compensation.

The present invention will be exploited in the first instance on mine hunters and other marine vessels which are only armed with light and/or medium-heavy antiaircraft and general target guns.

If they are to succeed with their principal task, which, as the name implies, is to hunt mines, the mine hunters must not themselves trigger off the mines they are supposed to hunt. The magnetic identities of the mine hunters projected today must therefore be kept below the anticipated sensitivity of the magnetic mines of tomorrow.

The magnetic interference field around a metal body, which thus gives this method body its magnetic identity, is primarily dependent upon the magnetic properties of the metal, the iron length, for example the greatest coherent length of magnetic material in the body, the intensity of the terrestrial magnetic field at the place where the body is situated and the direction of the body in relation to the terrestrial magnetic field.

Individual, large solid iron masses on a ship, such as engines etc, can be magnetically compensated with the aid of magnetic coils built into the hull and deck through which accurately adapted electric currents can be continuously passed.

Electrical compensation of a complete steel ship, however, requires far too high units of power to afford a realistic solution to the problem. In view of this, normal practice has been to build the mine hunters in a non-magnetic material such as wood, aluminum or, in recent times, plastic. All large iron objects on board, such as engines, propeller shafts and heavy weapons, have subsequently been magnetically compensated individually. Since the magentic interference field of a body is dependent upon the terrestrial magnetic field which, in turn, is dependent upon latitude and also exposed to local variations which are not directly dependent upon latitude, the magnetic compensation of ship parts has had to be restricted with the technology available hitherto to the latitudes and areas in which the ship concerned has had its main duties. This has led to major problems for such marine vessels when they move over large areas of sea.

For ship guns with a minimized magnetic identity, this will be largely dependent upon their elevating systems, such as barrel and mechanism, since the mounting can normally be divided into several separate parts with non-magnetic material between the parts. As a guide value, it can be considered that if a coherent iron length gives rise to a certain magnetic interference field, then the same iron length, divided into two equally long partial lengths disposed one after the other but separated by a non-magnetic material only gives rise to an interference field which is 25 percent of the interference field of the coherent iron length.

If the guns are equipped with large platforms of electrically conducting material, so-called eddy currents are formed when the ship moves in the sea and thus through the terrestrial magnetic field. The alternating field then formed may, however, be relatively simply limited in that the branch circuits for the eddy currents are broken by non-electrically conducting material which divides the platforms into several parts.

With the technology available hitherto, it has only been possible to magnetically compensate the traversing and elevating systems of the ship's guns in a fixed zero position relative to the vessel. The implication, then, is that it has not been possible to bring the ship's gun into the firing position without jeopardizing the magnetic compensation of the ship.

The normal procedure hitherto, therefore, has been to restrict the armament of the mine hunters to only one or a few light antiaircraft guns. This in turn highly limits the utility of the ships for other combat tasks than pure mine hunting, and capability of the ships to undertake their own protection against enemy aircraft and small surface water vessels.

SUMMARY OF THE PRESENT INVENTION

The object of the present invention is to solve the problems outlined above and to provide a method to magnetically compensate such light or medium-heavy general target and antiaircraft guns, regardless of the position on the earth, course, speed and rolling and pitching angles, as well as the elevation and angle of traverse of such gun, the aiming and firing of which is controlled by a qualified computer.

According to the invention, the computer is programmed not only to control the aiming of the gun and to direct firing when so required, but also on the basis of all the data to which the computer has access via appropriately adapted interface units from the ship's log and a gyro reference unit and angle transducer provided on the gun in question concerning the speed of the ship, its latitude, course and rolling and pitching angles, as well as the elevation and angle of traverse of the gun, to calculate the current necessary at any occasion for magnetic compensation of the gun, by means of magnetic coils built in around the gun and/or provided on the gun and to automatically control, via amplifiers, currents of a calculate of a computed value through the magnetic coils. In certain cases, one or more of the above listed points of departure may have such little effect on the final result that they can be disregarded. The invention thus implies a continuous active control of the magnetization current through a number of magnetic coils of in themselves known type provided around and on the gun.

Provided that the capacity of the computer and the availability of electric power are sufficient, several mobile units with their own angle transducers can be connected to the same gyro reference unit and computer for magnetic compensation by means of magnetic coils disposed around and/or on the respective unit. This applies, for example, to several guns which during firing are command-controlled via the same computer but could also comply, for example, to an artillery gun and a crane necessary for the mine hunting work. The invention can obviously also be utilized for magnetic compensation of other turnable and/or elevatable ship devices such as missile and torpedo ramps, fire control devices etc.

By means of the present invention it has thus become possible not only to reduce the risk of a mine hunter equipped in the manner discribed above to trigger off on account of its own magnetic identity the magnetic mines which it is its duty to render harmess. The present invention also provides a possibility of equipping mine hunters with better armament for their own protection and to improve the usefulness of the vessels for other purposes than mine hunting. Obviously, the invention can also be used on vessels other than mine hunters, but as a rule these have such a powerful magnetic identity of their own that the value of the invention would there probably not be particularly great.

The present invention will now be further described in conjunction with the appended FIGURE. This shows the principles for the invention without becoming deeply involved in the parts included therein, each of which is based on known technique.

DESCRIPTION OF THE PREFERRED EMBODIMENT

The FIGURE presents the arrangement of the system in principle. In order to avoid certain parts mounted on each other from hiding each other on the FIGURE these have been partly separated along the broken lines. The FIGURE shows the fully automatic antiaircraft or general target gun 1 comprising a turnable platform 2, a mounting 3 mounted on the platform, and an elevating system 4 mounted in the mounting and comprising a barrel 5, a mechanism box 6 with mechanism, cartridge magazine, laying means etc. The gun 1 is mounted on the deck of a ship (not shown). Platform 2 is, as indicated by the arrow A, turnably mounted on the deck. The movements for the elevating system 4 are indicated by the arrows B and C.

Disposed around the gun are a plurality of electromagnetic compensation coils 7–9. For the sake of clarity, these coils have been drawn below the platform 2 and not on the platform where they are actually permanently installed. They can also be mounted directly on the gun mounting 3. A fourth coil 10 is, as indicated by a broken line, mounted around the barrel 5 of the gun 1. As evident from the figure, the coils are further connected each to their own regulatable amplifier 11–14. These amplifiers are in turn linked to and controlled by a computer 15, which also controls the aiming and firing of the gun. The function of the computer as a fire control computer is based on known technology and will therefore not be more closely described in the present context.

The computer 15 is also connected via a first interface unit 16 to the log 17 of the ship and via a second interface unit 18 both to a gyro reference unit 19 mounted on the gun and to two angle transducers 20 and 21 disposed at the vertical and horizontal torsional access respectively of the gun. The latter record and transmit information on the angle of traverse and elevation of the gun, while the gyro reference unit 19 registers and transmits to the computer 15 information on latitude and course, and on rolling and pitching position, whereas information on the speed of the ship is taken from its log 17.

According to the invention the computer 15 is so programmed that it not only directs the aiming and possibly the firing of the gun 1 but also continually collects information on the speed of the ship from the log 15 and information on the latitude, course, rolling and stamping position of the ship from the gyro reference unit 19, and information on the angle of traverse and elevation of the gun relative to a predetermined zero position from the angle transducers 20 and 21. It takes these data as the point of departure together with initial data concerning the magnetic identity in the zero position (maximum iron length in the horizontal and vertical plane) of the gun 1, and the capacity of the coil 7–10, and calculates current which on each separate occasion must be passed through the individual coils to compensate the magnetic identity of the gun 1 itself. The computer controls the amplifiers 11–14 so that these supply the coils with calculated currents. Local irregularities in the terrestial magnetic field and other influencing factors of importance in the context are also programmed into the computer 15.

The previously mentioned gun platform 2 is equipped with a light armoured protection 22 for the gun crew. In order to restrict the occurrence of eddy currents in this protective armour it has been divided into several parts (**22*a* and 22*b* in the illustration) separated from each other by electrically non-conductive material 23 and 24**.

We claim:

1. A method of reducing magnetic identity for a ship provided with movable ship parts such as artillery guns and cranes having large irons lengths, and being movable transversely and in elevation relative to a zero point, comprising the steps of:

providing a computer unit continuously with input data concerning the latitude of the ship, local irregularities in the terrestrial magnetic field, ship's course, speed, pitching and rolling position from the ship's log through interface units;

simultaneously providing said computer unit with input data concerning angles of elevation and transverse of said movable ship parts with respect to said zero position from gyro reference units coordinated with said ship parts through interface units; and, feeding magnetic coils which are built into the ship or arranged on said ship parts with electric current continuously calculated and controlled by said computer unit for every coil based on said input data from continuous compensation of the magnetic identity of the ship.

2. A method according to claim 1 wherein said computer and gyro reference unit also control aiming, fire control and firing of the gun part on the ship.

3. An apparatus for reduction of the magnetic identity of the ship provided with parts having large iron lengths such as artillery guns and cranes and being movable transversely and in elevation with respect to a zero point comprising:

a plurality of electromagnetic coils disposed on said parts for controlling said reduction of said magnetic identitiy with continuously calculated, predetermined electrical current;

a plurality of amplifiers connected to said coil for supplying said coils with electrical current; and, a computer unit for receiving input data through interface units from log of the ship, gyro units and angle transducers concerning latitude of the ship, rolling and pitching angles, terrestrial irregularities, and angle of transverse and elevation of said parts, to continuously calculate electric control signals based on said received input data and supply said signals to said amplifiers.

4. An apparatus according to claim 3 wherein said computer unit further controls aiming and firing of the gun parts on the ship.

* * * * *